US005743140A

United States Patent [19]

Gustafson

[11] Patent Number: 5,743,140

[45] Date of Patent: Apr. 28, 1998

[54] UNIVERSAL STARTER MOTOR ATTACHMENT ANGLE ADJUSTMENT

[76] Inventor: Keith A. Gustafson, 415 Essex Ave., Gloucester, Mass. 01830

[21] Appl. No.: 659,864

[22] Filed: Jun. 7, 1996

[51] Int. Cl.[6] ..... F02N 15/00

[52] U.S. Cl. ..... 74/6; 248/200

[58] Field of Search ..... 74/6; 29/401.1; 248/200, 220.22, 674; 403/3, 4

[56] References Cited

U.S. PATENT DOCUMENTS

| | | | |
|---|---|---|---|
| D. 287,130 | 12/1986 | Tilton, Jr. | D15/5 |
| D. 287,159 | 12/1986 | Tilton, Jr. | D15/5 |
| 1,555,511 | 9/1925 | Muir . | |
| 2,441,990 | 5/1948 | Calhoun | 74/606 |
| 2,475,173 | 7/1949 | Bennett et al. | 74/7 |
| 3,293,924 | 12/1966 | Costelli | 74/6 |
| 3,500,531 | 3/1970 | Wright | 29/401 |
| 4,155,266 | 5/1979 | Bradley | 74/6 |
| 4,362,065 | 12/1982 | Baratti | 74/7 |
| 4,400,007 | 8/1983 | Ingalls | 280/661 |
| 4,601,378 | 7/1986 | Pierce et al. | 248/674 |
| 4,849,665 | 7/1989 | Kitamura et al. | 248/674 |
| 4,921,271 | 5/1990 | Berry et al. | 280/661 |
| 4,948,160 | 8/1990 | Barry | 280/661 |
| 5,036,575 | 8/1991 | Campion et al. | 29/401.1 |
| 5,105,637 | 4/1992 | Kovens | 70/491 |
| 5,163,335 | 11/1992 | Isom et al. | 744/6 |
| 5,299,880 | 4/1994 | Bouchard | 403/3 |
| 5,366,312 | 11/1994 | Raines | 403/3 |

*Primary Examiner*—Khoi Q. Ta
*Assistant Examiner*—Troy Grabow
*Attorney, Agent, or Firm*—Weingarten, Schurgin, Gagnebin & Hayes LLP

[57] ABSTRACT

A starter motor attachment angle adjusting method and apparatus which enable a starter motor to be attached to an internal combustion engine in a variety of rotational positions are disclosed. The apparatus includes an adaptive ring with a plurality of threaded position defining holes, and an adapter with a plurality of holes by which the adapter is securely connected to the adaptive ring by bolts. The position defining holes in the adaptive ring allow the adapter to be rotationally repositioned with respect to the adaptive ring. The adaptive ring is connected to the starter motor and the adapter is connected to the engine. Hence, the starter can be attached to the engine in a variety of rotational positions. Further, the apparatus allows rotational repositioning without interfering with transverse securing bolts which connect the adapter to the engine. Alternatively, the adaptive ring has a polygonal outer edge which interlocks in a plurality of rotational positions with a recess formed in the adapter.

19 Claims, 4 Drawing Sheets

UNIVERSAL STARTER MOTOR ATTACHMENT ANGLE ADJUSTMENT

FIELD OF THE INVENTION

The present invention is generally related to starter motors for internal combustion engines, and more particularly to adapting a starter motor for use with a variety of types of engines.

BACKGROUND OF THE INVENTION

Adapting a starter motor for use with an engine other than that for which the starter motor was originally designed is known. Typically, such adaptations are made on automobiles which are being modified for the purpose of racing. The adaptation allows desirable weight reduction by mounting a normally incompatible, small, lightweight starter on a large displacement engine. Adaptation of a normally incompatible starter is also known for replacement of expensive or difficult to locate starters on exotic or antique automobiles. Known starter adaptation techniques however require precision, custom machining work and are thus labor intensive and costly. An inexpensive assembly which facilitates the mounting of a starter motor to an engine would therefore be desirable.

SUMMARY OF THE INVENTION

In accordance with the present invention, a starter motor attachment angle apparatus for connecting a starter motor to an engine includes an adaptive ring with a plurality of attachment holes by which the adaptive ring can be secured to the starter motor with attachment bolts. The adaptive ring includes a plurality of discrete sets of position defining holes, whereby an adapter with a plurality of securing holes can be connected to the adaptive ring by attachment bolts which secure to a desired set of position defining holes on the adaptive ring. The adapter further includes mounting holes for securing the adapter to the engine with mounting bolts. The above described structure allows the starter to be attached to the engine in a variety of rotational positions.

The starter motor attachment angle adapter of the present invention advantageously allows attachment of a normally incompatible starter to an engine with reduced labor and machining requirements for installation. The adaptive ring is reconfigured to securely connect to the starter through attachment holes. More particularly, the position defining holes are reconfigured to align with the securing holes of the adapter. Labor and machining requirements are reduced because the need for precision machining and reworking of the bearing housing and adapter are eliminated. Some machining of the adapter and housing may be desirable for proper interfacing therebetween, however such machining is relatively simple to perform. Further, machining of the housing and adapter may be eliminated by providing suitable manufactured parts.

The attachment angle apparatus is particularly well suited for attachment of normally incompatible starters to engines with transverse mounting holes in the adapter. Some engines, such as V-8 engines manufactured by General Motors, utilize transverse mounted bolts to mount the starter motor, i.e., the adapter-to-engine holes and bolts are an orthogonal projection of the axis in which the adapter-to-starter securing bolts are secured. It is normally difficult to rotationally reposition such a starter since the required machining interferes with the adapter-to-engine holes. The adaptive ring simplifies such transverse mounting by obviating the need for extensive machining and by utilizing the pre-drilled adapter-to-starter securing holes on the adapter to secure the adapter to the adaptive ring and avoid interference with the adapter-to-engine holes.

BRIEF DESCRIPTION OF THE DRAWING

Other features and advantages of the present invention will become apparent in light of the following detailed description of the drawing in which.

DETAILED DESCRIPTION OF THE DRAWING

Figure 1:
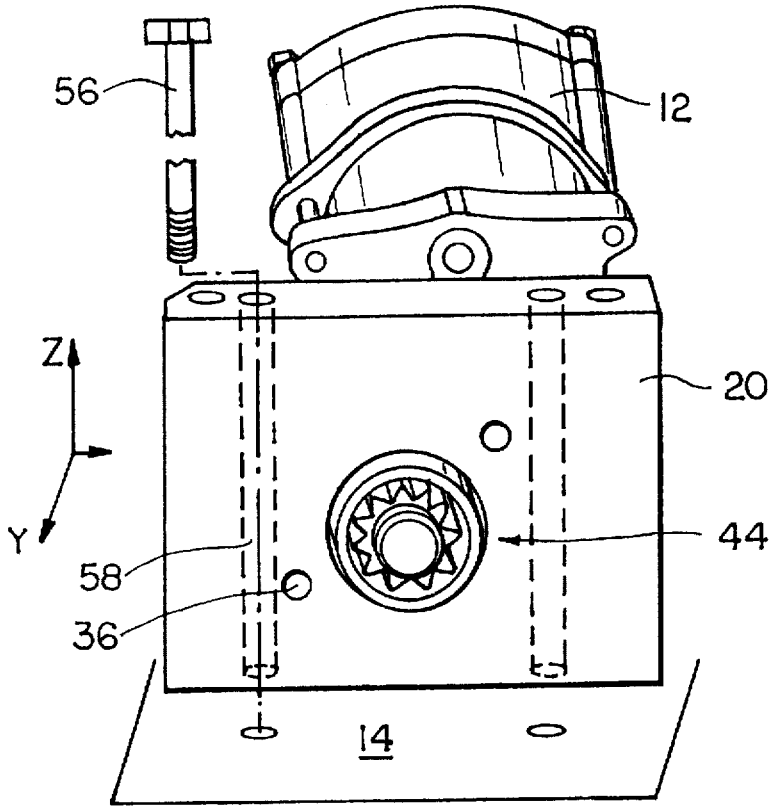
- FIG. 1 is a perspective view of the starter motor attachment angle adapter of the present invention connected to a starter.
Figure 2:
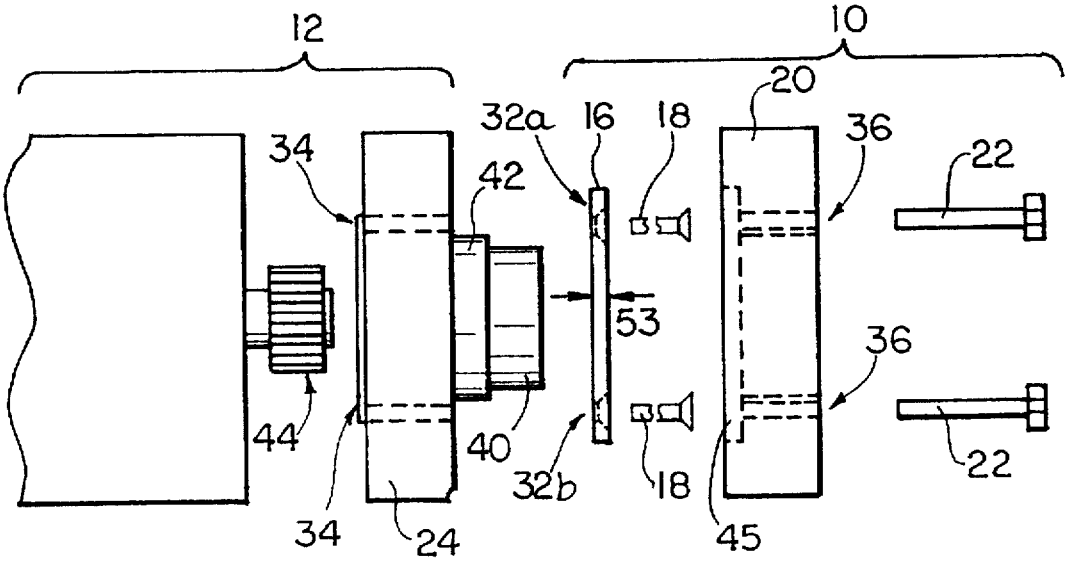
- FIG. 2 is a side view of the starter motor attachment angle adapter of FIG. 1.

Referring now to FIGS. 1 and 2, a starter motor attachment angle adapter 10 is employed to connect a starter motor 12 to an engine 14 in a desired rotational position. The attachment angle adapter 10 includes an adaptive ring 16, primary attachment bolts 18, an adapter 20, and secondary attachment bolts 22. The adapter and bearing housing may be machined from an adapter and bearing housing originally supplied by the manufacturer with the starter motor or engine.

Figure 3:
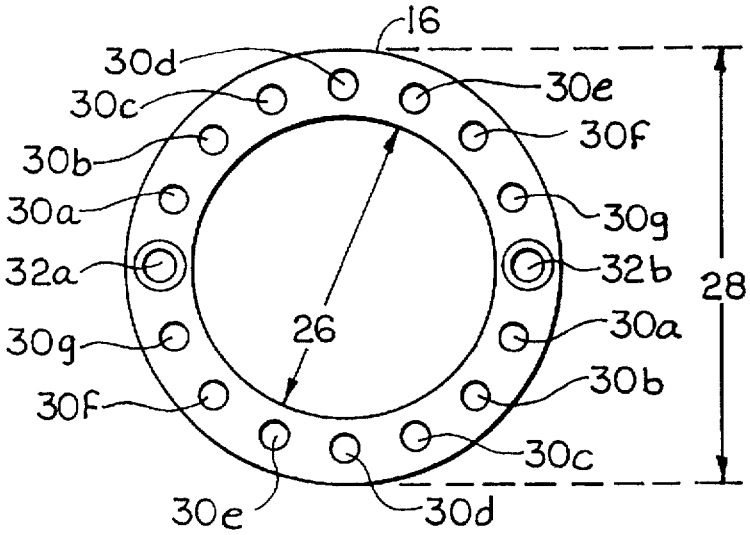
- FIG. 3 is a front view of the adaptive ring.

To secure the starter motor in a desired rotational position, the starter motor attaches to the adaptive ring, which in turn attaches to the adapter, which in turn attaches to the engine. The attachment angle adapter 10 is secured to the starter motor 12 through the bearing housing 24. Referring now to FIGS. 2 and 3, the adaptive ring 16 has an inside diameter 26 and an outside diameter 28, and includes two primary attachment holes 32*a*, 32*b* and sets of secondary, position defining threaded attachment holes 30*a*, 30*b*, 30*c*, 30*d*, 30*e*, 30*f* and 30*g*. The adaptive ring is secured to the bearing housing 24 by inserting the two primary attachment bolts 18 through the primary attachment holes and securing the bolts to threaded holes 34 in the bearing housing. The adapter 20 is then secured to the adaptive ring 16 by inserting the secondary attachment bolts 22 through alignment holes 36 in the adapter, and securing the bolts to a set of aligned secondary attachment holes providing a desired rotational position. It will therefore be appreciated that the rotational position of the starter motor with respect to the engine is determined by the selection of corresponding aligning secondary attachment holes to which the secondary attachment bolts are secured.

As shown in FIGS. 1–3, the bearing housing 24 includes an inner cowl 40 and an outer cowl 42 which surround the starter gear 44. In order to properly interface with the starter motor, the adaptive ring is configured to fit over both the inner and outer cowls. More particularly, the adaptive ring inside diameter 26 is sufficiently large to fit around the inner and outer cowls. The bearing housing may be machined to further facilitate a flush fit between the bearing housing and adaptive ring.

Figure 4:
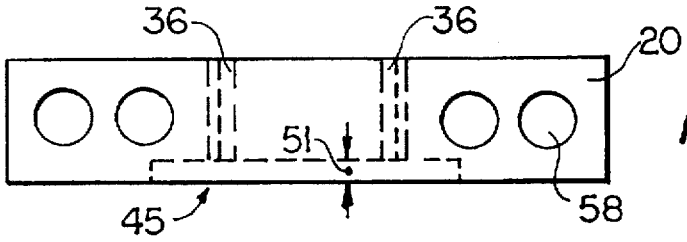
- FIG. 4 is a top view of the adapter.
Figure 5:
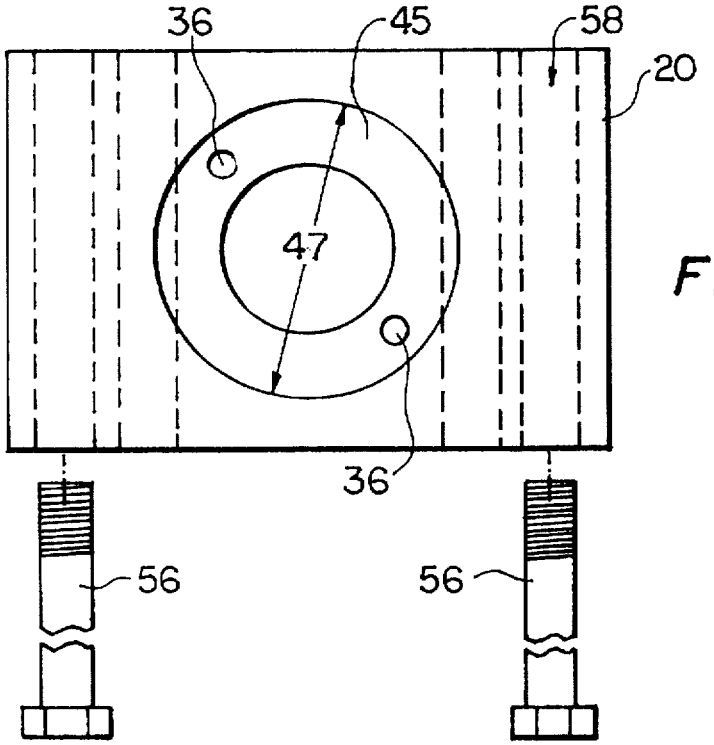
- FIG. 5 is a front view of the adapter.

Referring to FIGS. 2, 4 and 5, the adapter is machined to provide a flush fit between the adapter and the bearing housing. More particularly, a circular recess 45 is machined into the adapter 20 to accept the adaptive ring 16 when the angle adapter is assembled. The recess includes a diameter 47 which is at least as large as the outside diameter 28 of the adaptive ring. The recess has a depth 51 which is approximately equal to the thickness 53 of the adaptive ring. Further, the primary attachment holes 32*a–g* on the adaptive ring are countersunk, and flathead primary attachment bolts 18 are employed. Hence, when the attachment angle adapter is assembled the adaptive ring 16 and adapter 20 are flush with the bearing housing 24.

As illustrated in FIGS. 1, 4 and 5, the attachment angle adapter is particularly well suited to use with transverse adapter-to-engine attachment bolts 56. Once the starter motor, adaptive ring and adapter are connected, the adapter 20 is bolted to the engine 14 through transverse mounting holes 58. The holes 58 are transverse since they are parallel to an axis, e.g., the Z-axis, which is an orthogonal projection of the axis of the alignment holes 36, e.g., the Y-axis. If repositioning of the adapter were attempted by drilling new alignment holes there would be a possibility that the new holes would interfere with the transverse mounting holes 58. The adaptive ring eliminates this problem since the predrilled alignment holes 36 are utilized to connect the adapter to the starter.

Figure 6:
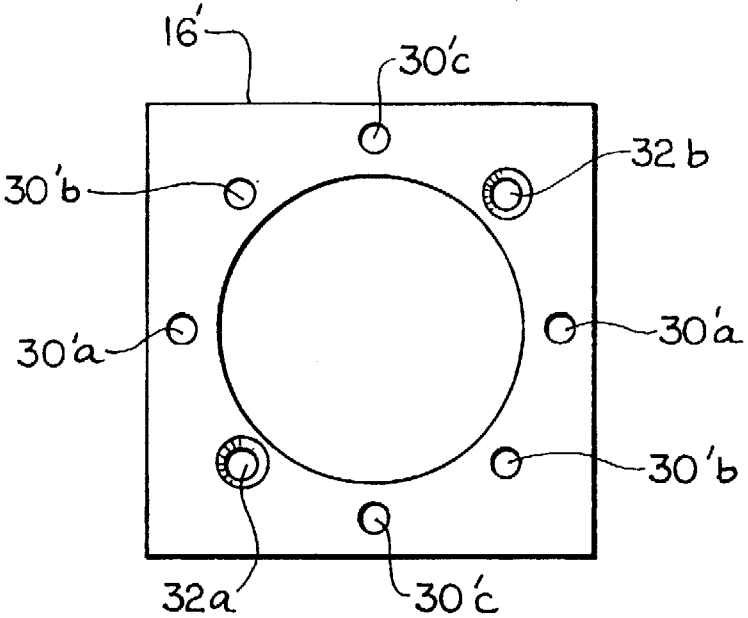
- FIG. 6 is an alternative embodiment of the adaptive ring of FIG. 3.

In the embodiment of FIG. 3 the adaptive ring 16 includes seven sets of secondary attachment holes 30*a–g* at 22.5 degree intervals and a substantially circular outside edge. However, in an alternative embodiment illustrated in FIG. 6 the adaptive ring 16' includes three sets of secondary attachment holes 30'*a*, 30'*b*, 30'*c* at 45 degree intervals and a substantially rectangular outer edge. It has also been found through testing that an adaptive ring with secondary attachment holes at 15 degree intervals can be manufactured and is potentially useful with relatively small, inexpensive starter motors such as those manufactured by Nippondenso. Generally, a greater number of secondary attachment holes disposed in close angular proximity provides a greater number of discrete rotational positions at which the starter motor may be mounted.

Figure 7:
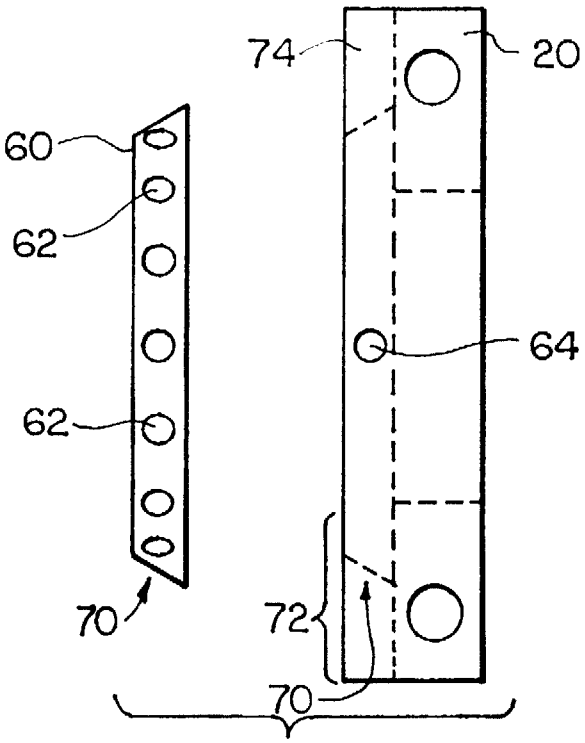
- FIGS. 7–8 illustrate an alternative embodiment having radial position defining holes.
Figure 8:
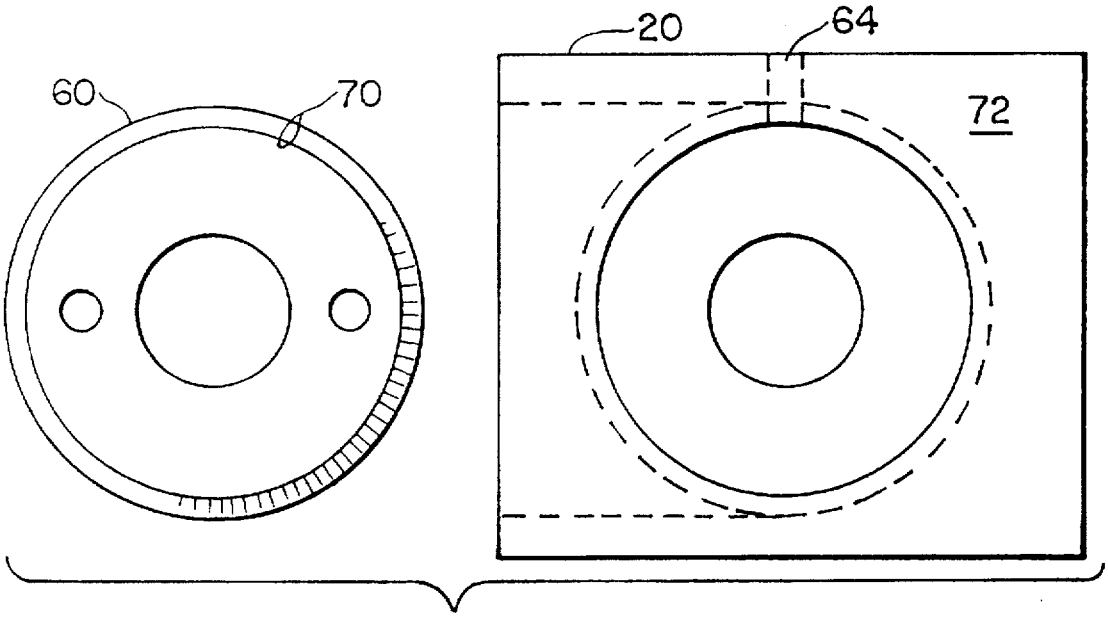

Referring now to FIGS. 7–8, in an alternative embodiment adaptive ring 60 includes radial position defining holes 62. The radial position defining holes extend from an outer edge of the adaptive ring to an inner edge of the adaptive ring. The adapter includes at least one securing hole 64 which extends from the outer edge 66 of the adapter to the recess 68 in the adapter. The adaptive ring is then rotationally positioned by aligning a selected radial position defining hole 62 with the securing hole 64, and securing the adaptive ring to the adapter with a bolt or other means.

In order to more securely hold the adaptive ring 60 in place, the recess and adaptive ring may have beveled edges 70. The beveled edges of the recess pinch inward proximate to the starter motor confronting surface 72 such that the adaptive ring is prevented from falling out of the recess. The adaptive ring is placed in the recess by removing a cover plate 74 which forms the recess when secured to the adapter. Preferably the recess includes sufficient clearance for the adaptive ring to move rotationally within the recess until secured in place.

Figure 9:
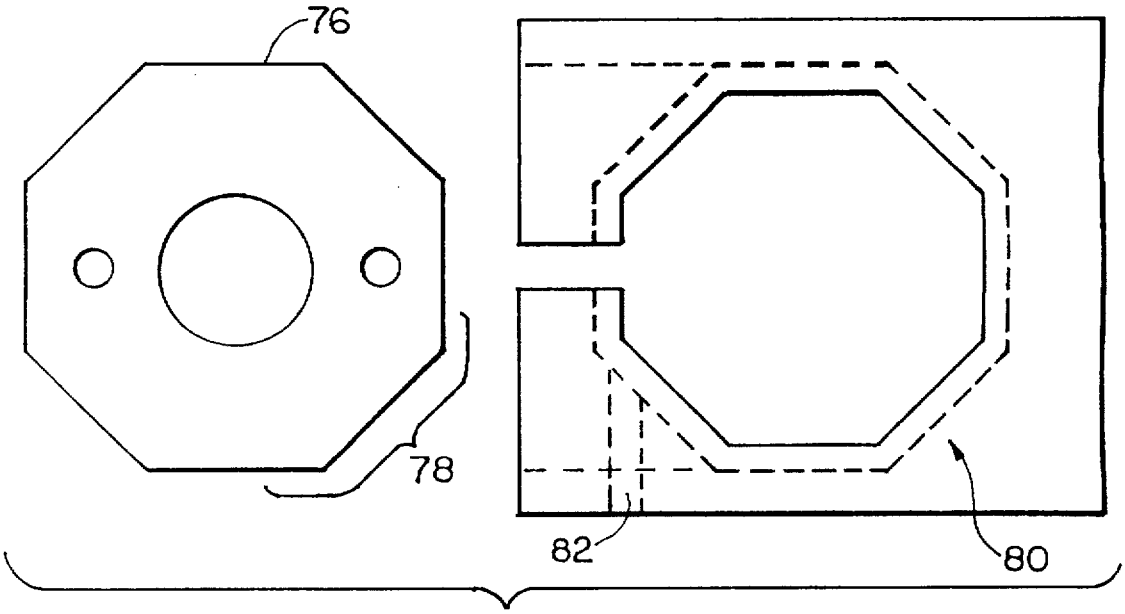
- FIG. 9 illustrates an alternative embodiment having a polygonal adaptive ring.

Referring now to FIG. 9, an adaptive ring 76 may include a polygonal outer edge 78 which interlocks with a polygonal recess 80 in a plurality of discrete rotational positions. The interlocking edges of the polygonal adaptive ring and recess provide indexing to possible rotational positions. When the desired rotational position is obtained, the adaptive ring is secured in the recess by tightening retaining bolts 82 which reduce clearance within the recess until frictional force between the recess wall and adaptive ring secure the adaptive ring in place.

It should be understood that various changes and modifications may be made from the embodiment herein disclosed. Accordingly, the invention is not to be viewed as limited except by the scope and spirit of the appended claims.

What is claimed:

1. A mounting adapter for mounting a starter motor having at least two threaded starter motor holes to an engine mount having at least two engine mount holes, comprising:

an intermediate adapter having a starter motor confronting side and an engine mount confronting side, said intermediate adapter having a central opening through said intermediate adapter from said starter motor confronting side to said engine mount confronting side;

said intermediate adapter having a first member including at least two primary attachment holes and at least two secondary attachment holes, said primary attachment holes positioned to coaxially align with said starter motor holes when said intermediate adapter is aligned in confronting relation to the starter motor; and a second member including a plurality of angle defining alignment holes extending through said second member, said angle defining alignment holes positioned such that predefined pairs of said secondary attachment holes coaxially align with said angle defining alignment holes when said second member is aligned in confronting relation with said first member, said second member being secured to the engine mount, whereby the angular mounting position of said starter motor is defined by the secondary attachment holes which are selected to be aligned in coaxial relation with said angle defining alignment holes.

2. The mounting adapter of claim 1 further including a plurality of transverse adapter-to-engine mounting holes disposed in the second member.

3. The mounting adapter of claim 2 wherein the first member includes an adaptive ring disposed between the starter motor and the starter motor confronting side of the second member, the primary attachment holes being formed in the adaptive ring, and wherein a circular recess is machined into the second member, said circular recess having a diameter and depth sufficient to accommodate said adaptive ring and provide a flush fit between the second member and the starter motor when said mounting adapter is assembled.

4. The mounting adapter of claim 3 wherein pairs of secondary attachment holes are disposed on said first member at intervals of fifteen to forty-five degrees.

5. The mounting adapter of claim 4 wherein said pairs of secondary attachment holes are disposed on said first member at intervals of 22.5 degrees.

6. The mounting adapter of claim 4 wherein said first member has seven pairs of secondary attachment holes.

7. The mounting adapter of claim 6 wherein said primary attachment holes are countersunk in said first member.

8. The mounting adapter of claim 4 wherein said first member has eleven pairs of secondary attachment holes.

9. A starter motor which is angularly adjustable with respect to an engine, said engine having a plurality of holes, comprising:

a starter motor section having at least first and second threaded mounting holes; and an intermediate adapter having a starter motor section confronting side and an engine confronting side, said intermediate adapter having a central opening through said intermediate adapter from said starter motor section confronting side to said engine confronting side;

said intermediate adapter having a first member including at least two primary attachment holes and at lest two secondary attachment holes, said primary attachment holes positioned to coaxially align with said threaded starter motor mounting holes when said intermediate adapter is aligned in confronting relation to the starter motor; and a second member including a plurality of angle defining alignment holes extending through said second member, said angle defining alignment holes positioned such that predefined pairs of said secondary attachment holes coaxially align with said angle defining alignment holes when said second member is aligned in confronting relation with said first member, said second member being secured to the engine mount, whereby the angular mounting position of said starter motor is defined by the secondary attachment holes which are aligned in confronting relation with said angle defining alignment holes, and the angular mounting position can be adjusted by aligning said alignment holes with a different set of said secondary attachment holes.

10. The starter motor of claim 9 wherein the second member includes transverse adapter-to-engine mounting holes.

11. The starter motor of claim 10 wherein the first member includes an adaptive ring disposed between the starter motor and the starter motor confronting side of the intermediate adapter, the primary attachment holes being formed in the adaptive ring, and wherein a circular recess is machined into the second member, said recess having a diameter and depth sufficient to accommodate said adaptive ring and provide a flush fit between the second member and the starter motor section when said starter motor is assembled.

12. The starter motor of claim 11 wherein pairs of secondary attachment holes are disposed on said first member at intervals of fifteen to forty-five degrees.

13. The starter motor of claim 12 wherein said pairs of secondary attachment holes are disposed on said first member at intervals of 22.5 degrees.

14. The starter motor of claim 11 wherein said first member has seven pairs of secondary attachment holes.

15. The starter motor of claim 14 wherein said primary attachment holes are countersunk into the first member.

16. The starter motor of claim 11 wherein said first member has eleven pairs of secondary attachment holes.

17. A method of mounting a starter motor having at least two mounting holes to an engine having at least two mounting holes, comprising the steps of:

providing an intermediate adapter having a starter motor confronting side and an engine confronting side, said intermediate adapter having a central opening through said intermediate adapter from said starter motor confronting side to said engine confronting side, said intermediate adapter further having a first member including at least two primary attachment holes and at least two secondary attachment holes, said primary attachment holes positioned to coaxially align with said starter motor mounting holes when said intermediate adapter is aligned in confronting relation to the starter motor, and a second member including a plurality of alignment holes extending through said second member, said secondary attachment holes positioned such that predefined pairs of said secondary attachment holes coaxially align with said alignment holes when said first member is aligned in confronting relation with said second member;

selecting and aligning a pair of secondary attachment holes which are aligned in confronting relation with said alignment holes such that the starter motor is at a desired angular position with respect to the engine; and securing the intermediate adapter to the engine.

18. The method of claim 17 wherein said providing step includes machining a recess in the second member such that said recess accepts an adaptive ring and provides a flush fit between said second member and the starter motor.

19. The method of claim 18 wherein said providing step further includes machining a flat surface on the starter motor to provide a flush fit between said intermediate adapter and the starter motor.

* * * * *